United States Patent [19]

Ewald

[11] 4,202,389

[45] May 13, 1980

[54] AIR CONDITIONER COVER ASSEMBLY

[76] Inventor: Marguerite Ewald, 402 N. Wenona St., Bay City, Mich. 48706

[21] Appl. No.: 23,639

[22] Filed: Mar. 26, 1979

[51] Int. Cl.[2] ..... A47B 81/00

[52] U.S. Cl. ..... 150/52 R; 312/101

[58] Field of Search ..... 150/52 R; 98/94 AC; 62/262; 312/101, 229

[56] References Cited

U.S. PATENT DOCUMENTS

| | | | |
|---|---|---|---|
| 2,294,664 | 9/1942 | Hubbard | 312/101 UX |
| 2,705,990 | 4/1955 | Miller | 150/52 R |
| 2,711,769 | 6/1955 | Katcher et al. | 150/52 R |
| 3,002,236 | 10/1961 | Humphner | 150/52 R X |

*Primary Examiner*—Donald F. Norton

*Attorney, Agent, or Firm*—Dorsey, Windhorst, Hannaford, Whitney & Halladay

[57] ABSTRACT

A cover assembly for an air conditioning unit of the type which projects outwardly from a chamber wall opening includes a cover member with an imperforate outer end wall, and imperforate top, bottom and side walls, and a cover-supporting flange at its open inner end, in combination with an intermediate adapter frame having inner and outer support surfaces and a central opening dimensioned to surround the air conditioning unit. The inner adapter support surface can be fitted in relatively fixed and sealed engagement against a chamber wall surrounding such a wall opening with the aid of a wall-sealing gasket and first fastening means, while the cover member can be selectively and removably assembled in sealing engagement with the outer support surface of the adapter frame with the aid of a cover-sealing gasket and cooperating manually-operable fastening means on the cover member and adapter frame.

10 Claims, 5 Drawing Figures

AIR CONDITIONER COVER ASSEMBLY

FIELD OF THE INVENTION

The invention relates to cover assemblies adapted to enclose and protect the portions of air conditioning units which project outwardly from chamber wall openings, such as the window opening of a house and the window or roof openings of a mobile home or trailer.

DESCRIPTION OF THE PRIOR ART

Various proposals have been made for enclosing and protecting the portion of an air conditioner which projects outwardly from a wall opening. For example, U.S. Pat. No. 2,711,769 discloses a removable cover formed of sheets of plastic material, canvas or other suitable flexible material which can be secured together to provide side walls, a rear wall and a top wall, with the resulting cover open at the bottom and at the "front end" (which is disposed toward the inside of the room from which the air conditioner projects). Since the cover is open at the bottom, it does not fully protect the air conditioner unit from the elements.

Another prior cover arrangement is shown in U.S. Pat. No. 3,002,236, entitled "Window Enclosure". In that patent, which states that the application for it constitutes a continuation-in-part of an earlier copending application which issued as U.S. Pat. No. 2,826,472, a window covering is disclosed which includes a plastic body molded to fit a window frame and having an integral transparent window panel, below which the plastic body projects outwardly to provide an integral container for an air conditioning unit mounted in the window. Although the container portion appears to enclose fully the outer portion of the air conditioning unit, it is formed as part of a single integral molded plastic body which includes a transparent window portion, such that the entire body is intended to serve as a complete storm window covering both the entire window area and the air conditioner unit. Thus the choice of plastic for the container portion of the window covering may be limited by the need for adequate transparency of the window panel portion, and the container portion is not readily and economically adaptable to use with existing storm windows of different size, or to known types of combination storm windows in which a removable storm window panel is provided.

SUMMARY OF THE INVENTION

The present invention provides a cover assembly for air conditioning units of the type which have an outer portion adapted to project outwardly from a chamber wall opening. Such assembly includes a cover member having an imperforate outer end wall and imperforate peripheral side, top and bottom walls which form a complete outer enclosure for the projecting portion of such a unit. The side, top and bottom walls of the cover member have inner edges providing a cover-supporting flange adapted to surround such an air conditioning unit close to such a chamber wall. The cover assembly of the invention also includes an intermediate adapter frame dimensioned to surround such an air conditioning unit and having inner and outer support surfaces adapted to face respectively toward and away from the chamber wall when assembled. The outer adapter frame surface is sized to receive and fit the supporting flange of the cover member, and the inner adapter surface is designed to fit around the chamber wall opening. The assembly further includes first fastening means for securing the intermediate adapter frame in relatively fixed and sealed engagement against the chamber wall around such an opening, and cooperating fastening means on the cover member and intermediate adapter frame for convenient selectively-removable sealing connection of the cover member to the adapter frame.

More specifically, the invention includes with the above combination of cover assembly elements a wall-sealing gasket dimensioned to fit around such chamber wall opening in sealing engagement between the chamber wall and the intermediate adapter frame, when the frame is secured in position by the first fastening means. The wall-sealing gasket preferably comprises resilient sponge-like material adapted to fit and seal the space between the chamber wall and adapter frame, despite possible irregularities in the surfaces of such wall and frame.

The cover assembly preferably also includes the further combination of a cover-sealing gasket dimensioned to fit around such an air conditioning unit in sealing engagement between the cover supporting flange and the outer support surface of the intermediate adapter frame, when the cover is secured to the frame by the cooperating fastening means. The cover-sealing gasket preferably comprises a cork gasket layer.

The cover assembly of this invention is particularly adapted for use in connection with combination window assemblies of the type in which an outer storm window portion has a removable storm window panel, which can be replaced by a removable nontransparent supporting sheet of wood or other suitable material having a central opening to accommodate an air conditioning window unit and providing a supporting chamber wall portion to which the inner support surface of the intermediate adapter frame can be secured by the first fastening means described above.

Further features and details of the present invention will be apparent from the following detailed description of a preferred embodiment.

BRIEF DESCRIPTION OF THE DRAWINGS

In the drawings which form a part of this application, and in which like reference characters indicate like parts.

DESCRIPTION OF THE PREFERRED EMBODIMENT

Figure 1:
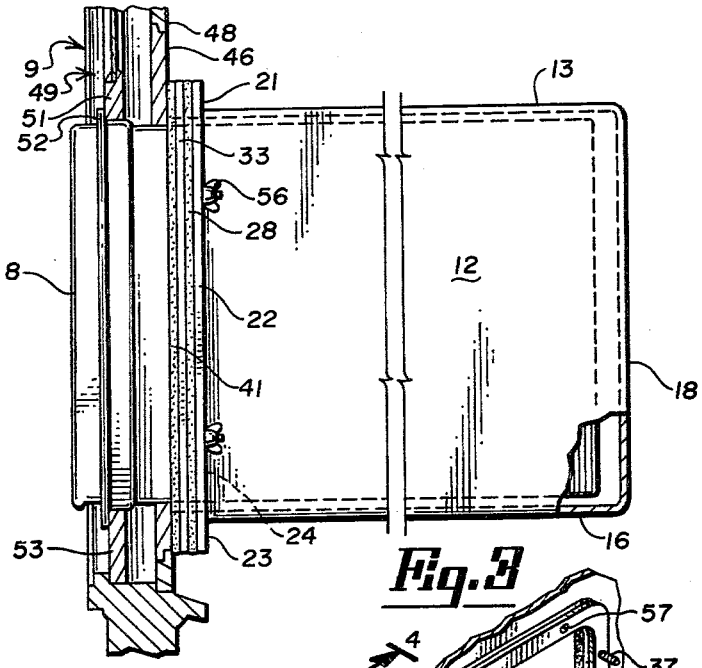
FIG. 1 is a side elevation of a cover assembly according to the invention, with the assembly mounted in position around an air conditioning unit projecting from a chamber wall portion, and with certain of the elements of the chamber wall portion shown in section.

As shown in the drawing, the cover assembly of the invention includes a cover member 12 formed of suitable plastic or other protective material and designed to provide a complete outer enclosure for the projecting portion of an air conditioning unit. This enclosure includes imperforate walls, such as top wall 13, side walls 14 and 17, bottom wall 16 and outer end wall 18. At its inner end, the cover member 12 has a cover supporting flange 19 formed by the coplanar portions projecting outwardly from the inner edges of the top and bottom walls as shown at 21, 23 and the opposite side walls, as shown at 22, 24. Appropriate assembly and fastening openings 26 and 27 are provided in the cover-supporting flange 19, as illustrated in flange portions 22 and 24 at opposite sides of the cover member.

Between the cover supporting flange 19 and the intermediate adapter frame described below, the preferred cover assembly combination includes a cover-sealing gasket 28 which is shaped and dimensioned to fit around the desired air conditioning unit in sealing engagement between the cover supporting flange 19 and the intermediate adapter frame, when the cover is fully assembled. Thus gasket 28 includes an outer rim portion 29 surrounding and defining a central opening 31 through which the air conditioning unit can project. Openings 32 in the rim of the cover-sealing gasket are aligned with openings 26 and 27 of the cover supporting flange 19.

The intermediate adapter frame 33 of the present invention has a shape and size generally similar to that described for the cover-sealing gasket 28. It includes a rim-like body portion with an outer support surface 34A adapted to receive and fit the cover-sealing gasket 28 and flange 19. Intermediate adapter frame 33 also includes an oppositely facing inner support surface 34B, designed for sealing assembly against a suitable chamber wall portion. The rim-like shape of the intermediate adapter frame defines and provides an inner opening 36 which—like the inner opening 31 of the cover-sealing gasket 28 and the inner opening of the cover member 12—is adapted to surround the projecting body portion of the desired air conditioning unit.

The intermediate adapter frame is also provided with outwardly projecting threaded members 37 at locations corresponding to the openings 32 in the cover-sealing gasket and the openings 26, 27 of the cover-supporting flange 19. Threaded members 27 thus constitute part of a cooperating fastening means on the cover member and intermediate adapter frame for convenient selectively removable sealing connection of the cover member to the adapter frame, as further described below. The intermediate adapter frame 33 is also provided with openings 38 and 39, which constitute part of a first fastening means for securing the intermediate adapter frame in relatively fixed and sealed engagement against the desired chamber wall around the chamber wall opening through which an air conditioning unit can project. The elements of the respective fastening means are appropriately spaced at different peripheral positions around the rim of the adapter frame. As illustrated in the preferred embodiment, the fastening openings 38 and 39 are located in the upper and lower transverse portions of the adapter frame, while the forwardly projecting threaded members 37 are located in the opposite vertical side portions of the adapter frame.

The cover assembly of the invention further includes a wall-sealing gasket 41 having a rim-like body portion 42 corresponding in shape and dimension to the inner support surface 34B of the intermediate adapter frame 33. This frame portion 42 similarly defines an inner opening 43 adapted to fit around the desired air conditioning unit. Fastening openings 44 in the wall sealing gasket are aligned with the fastening openings 38 and 39 of the intermediate adapter frame, so that these two elements of the assembly can be readily secured against a suitable chamber wall portion 46 having a chamber wall opening 47, through which the outer portion of the air conditioning unit will project. As shown in FIG. 1, the chamber wall portion 46 consists of a wooden panel member adapted to fit removably within the outer storm window body 48 of a known combination window assembly. In such an assembly, a transparent window or screen of the same size as removable wall portion 46 may be removed readily from the inside of the sash, when desired for cleaning purposes or for a change of seasons. It is customary in the installation of air conditioning units in such a window assembly to provide a wooden supporting panel of the type shown at 46 to surround and partially support the air conditioning unit within the window assembly. Thus the removable panel 46 serves in effect as part of the chamber wall through which the air conditioning unit is to project and to which the cover assembly of the present invention is to be secured. The air conditioning unit is shown generally at 8 in FIG. 1 and the complete window assembly at 9.

The window assembly 9 includes an inner window portion 49 having a lower sash 51 which can be raised when the air conditioning unit 8 is being mounted in the window and can then be lowered against the top of the unit, just outside a flange portion 52 on the inner end of the air conditioning unit 8. An auxiliary support panel 52 may fit between the bottom of the air conditioner and the window sill. Thus the air conditioning unit is supported within the window or chamber wall opening in any desired normal fashion, while the cover assembly of the present invention can be secured to the outer chamber wall portion or panel 46 to fully enclose the outer end of the air conditioner, when so desired.

Figure 4:
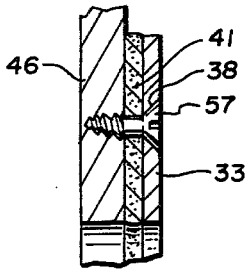
FIG. 4 is a partial sectional view on the line 4—4 of FIG. 3, to show details of the first fastening means.

To complete the mounting of the cover assembly, wing nuts 56 may be secured to threaded members 37, after the cover-sealing gasket 28 and cover member 12 have been placed in assembled position against the outer support surface 34A of adapter frame 33. That assembly will take place after the adapter frame 33 and wall sealing gasket 41 have been secured to the chamber wall member 46 by appropriate screws 57 (FIG. 4).

Figure 5:
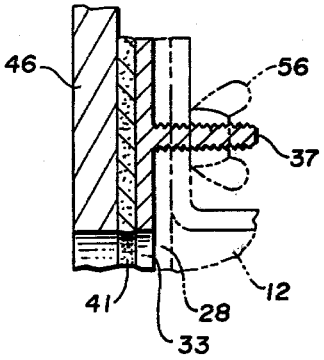
FIG. 5 is a partial sectional view taken along the line 5—5 of FIG. 3, with the cover member and cover-sealing gasket shown in phantom outline in the fully assembled position of FIG. 1.
Figure 3:
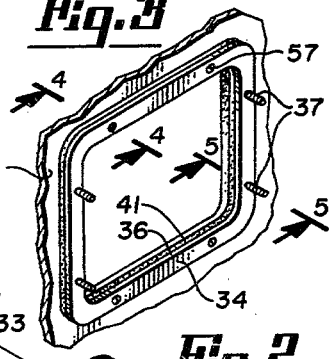
FIG. 3 is a partial perspective view of the chamber wall portion of FIGS. 1 and 2, with the intermediate adapter frame and wall-sealing gasket secured thereto as a first step in mounting the complete assembly.
Figure 2:
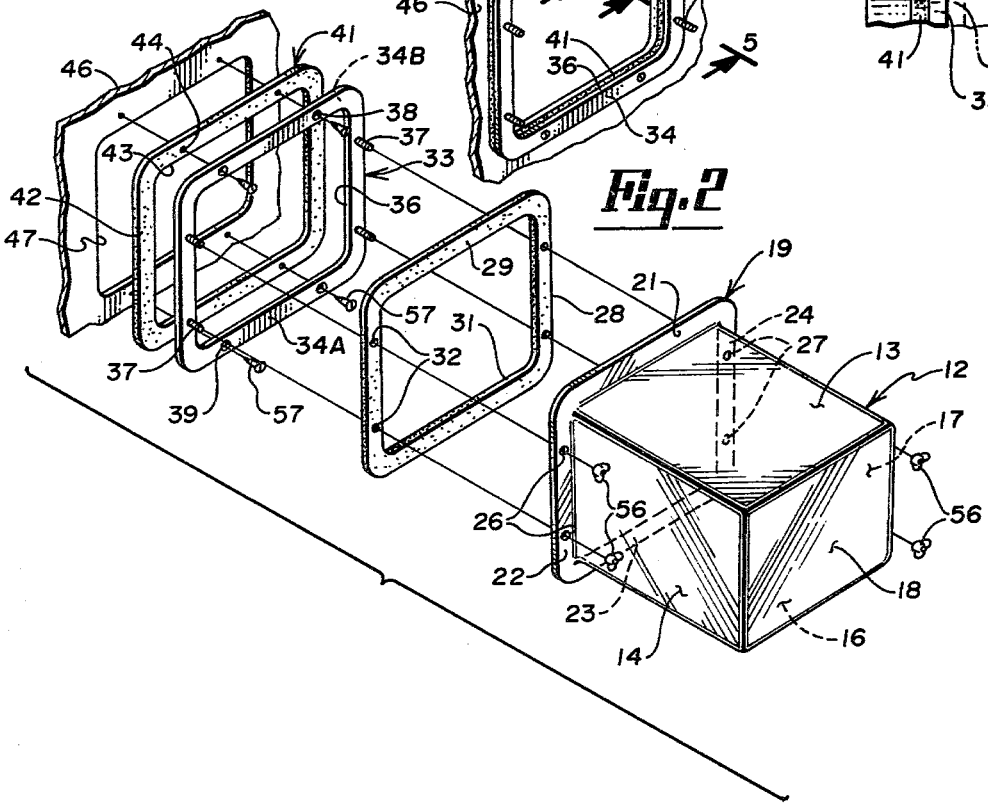
FIG. 2 is an exploded perspective view showing the elements of the cover assembly of FIG. 1 and a portion of the supporting chamber wall portion, to illustrate the details of the various elements of the assembly and the manner in which they are adapted for subsequent assembly.

Thus, the adapater frame and gasket 41 can be assembled in relatively permanent sealing engagement against the chamber wall portion 46 around the chamber wall opening 47, while the outer portion of the air conditioning unit projects through such elements outside the chamber wall during normal air conditioning operation. When conditions are such that the air conditioner is to be enclosed, for example to protect it against dust storms or other adverse weather elements, the cover member 12 and cover-sealing gasket 28 are then mounted in selectively-removable sealing engagement with the adapter frame, with the aid of wing nuts 56, as already described and as further shown in FIG. 5.

In the preferred form of the invention, the interior dimensions of the cover member 12 are chosen to fit around a plurality of air conditioner models which may have some variation in size. The preferred interior dimensions are 28" vertically, 32" laterally between walls 14 and 17, and 32" deep from end wall 18 to supporting flange 19. The cover member walls and the cover-supporting flange are preferably formed as integral parts of a single molded plastic cover member. The particular wall thickness of the cover member and the particular plastic material from which it is made can be varied according to the particular equipment and method of forming the cover desired by a particular plastic molding or forming company and according to the strength and rigidity needed for the cover walls and supporting flange.

The wall sealing gasket 41 is preferably made of resilient sponge-like material, such as sponge rubber, which can be substantially compressed from its original thickness and is thereby adapted to fit and seal the space between the chamber wall and adapter frame despite possible substantial irregularities in the surfaces of either or both of the wall and frame elements. The cover-sealing gasket 28, on the other hand, is prefereably made of cork or similar material, which can be reused a number of times as the cover member is selectively removed and placed in position for various weather or other conditions. The cover-sealing gasket 28 can also be of relatively fixed thickness, without the substantial resilience of wall-sealing gasket 41, since gasket 28 is adapted to fit and seal the space between the cover-supporting flange 19 and the outer support surface 34A of adapter frame 33, each of such surfaces being capable of formation under accurately-controlled manufacturing conditions by the maker of the cover assembly.

The intermediate adapter frame is preferably made of relatively light and rigid metallic construction, such as aluminum, in order to provide sufficiently rigid inner and outer support surfaces to insure adequate support for the cover member and smooth sealing engagement with the respective cover-sealing and wall-sealing gaskets.

The invention described herein thus provides an improved cover assembly for an air conditioning unit, in which an intermediate adapter frame can be secured in relatively fixed sealing engagement with a chamber wall portion around a chamber opening through which the outer portion of an air conditioning unit is adapted to project. At the same time, the cover member of the invention can be readily and removably secured to the intermediate adapter frame by the manually-operable cooperating fastening means, such as wing nuts 56, without the problems of having to make a relatively tight and permanent connection of the entire cover member, each time it is desired to enclose the air conditioner with a completely imperforate cover or container portion. As described, the unit is particularly adaptable for use with combination windows in which an outer storm window or screen portion is normally removable and replaceable by a panel adapted for supporting and/or surrounding the projecting body portion of a window-mounted air conditioning unit. The cover assembly can also be used with other chamber wall air conditioner openings, such as the window and roof openings of trailers and mobile homes.

The foregoing specification sets forth the preferred embodiments and modifications of the invention and some of the ways in which the invention may be put into practice, including the best mode presently contemplated by the inventor for carrying out this invention. Modifications of the described embodiment, as well as alternate embodiments and devices for carrying out the invention may also be apparent to those skilled in the art, within the spirit and scope of the following claims.

I claim:

1. A cover assembly for an air conditioning unit of the type which has a portion adapted to project outwardly from a chamber wall opening, said assembly comprising a cover member having an imperforate outer end wall and imperforate peripheral side, top and bottom walls forming a complete outer enclosure for the projecting portion of such a unit, said side, top and bottom walls having inner edges providing a cover-supporting flange surrounding such an air conditioning unit close to such a chamber wall, an intermediate adapter frame dimensioned to surround such unit and having inner and outer support surfaces adapted to face respectively toward and away from such chamber wall when assembled, the outer adapter frame surface being sized to fit the supporting flange of the cover member, and the inner adapter surface being adapted to fit around such a chamber wall opening, first fastening means for securing the intermediate adapter frame in relatively fixed and sealed engagement against such chamber wall around the chamber wall opening, and cooperating fastening means on the cover member and intermediate adapter frame for convenient selectively-removable sealing connection of the cover member to the adapter frame.

2. A cover assembly according to claim 1 having a wall-sealing gasket dimensioned to fit around such chamber wall opening in sealing engagement between the chamber wall and intermediate adapter frame when the frame is secured in position by the first fastening means.

3. A cover assembly according to claim 2 in which the wall-sealing gasket comprises resilient sponge-like material adapted to fit and seal the space between the chamber wall and adapter frame despite possible irregularities in the surfaces of such wall and frame.

4. A cover assembly according to claim 1 having a cover-sealing gasket dimensioned to fit around such air conditioning unit in sealing engagement between the cover supporting flange and intermediate adapter frame when the cover is secured to the frame by said cooperating fastening means.

5. A cover assembly according to claim 4 in which the cover-sealing gasket comprises a cork gasket layer adapted to fit and fill the space between the cover flange and adapter frame.

6. A cover assembly according to claim 4 having a wall-sealing gasket dimensioned to fit around such chamber wall opening in sealing engagement between the chamber wall and intermediate adapter frame when the frame is secured in position by the first fastening means.

7. A cover assembly according to claim 6 in which the cooperating fastening means includes threaded members having manually operable grasping portions readily accessible along the cover-supporting flange when the cover and cover-sealing gasket are assembled with the adapter frame.

8. A cover assembly according to claim 6 in which the first fastening means comprises aligned openings around the periphery of the respective adapter frame and wall-sealing gasket, through which fastening screws may be inserted from the outer surface of the adapter frame into the chamber wall around such a chamber wall opening, and in which the cooperating fastening means includes outwardly-projecting threaded studs fixed around the periphery of the adapter frame, aligned openings in the cover-sealing gasket and cover flange to fit over the projecting studs, and retaining nuts for threaded engagement on the projecting studs, with the cover-sealing gasket and cover flange thereby adapted for clamped engagement between the retaining nuts and adapter frame.

9. A cover assembly according to claim 8 in which the cover member walls and cover-supporting flange are integral parts of a single molded plastic cover member and the intermediate adapter frame is a substantially rigid metallic frame.

10. A cover assembly according to claim 9 in which the retaining nuts for the cover-sealing gasket and cover flange are manually operable wing nuts.

* * * * *